US005263603A

United States Patent [19]

McBride

[11] Patent Number: 5,263,603

[45] Date of Patent: Nov. 23, 1993

[54] INSULATION SYSTEM FOR STORAGE TANKS

[75] Inventor: Mark A. McBride, Houston, Tex.

[73] Assignee: Insultherm, Inc., La Porte, Tex.

[21] Appl. No.: 16,118

[22] Filed: Feb. 10, 1993

[51] Int. Cl.[5] ..... B65D 25/16; B65D 90/06

[52] U.S. Cl. ..... 220/435; 220/565; 220/421; 52/248; 52/249

[58] Field of Search ..... 52/248, 249, 80.1, 81.4, 52/81.5; 220/421, 454, 457, 455, 445, 446, 468, 469, 4.01, 4.12, 435, 751, 901, 565, 567, 646, 647, 648, 650, 436, 437, 439

[56] References Cited

U.S. PATENT DOCUMENTS

| | | | |
|---|---|---|---|
| 1,688,868 | 10/1928 | Horton | 220/563 |
| 2,209,420 | 7/1940 | Rutten et al. | 189/3 |
| 2,323,297 | 7/1943 | Collins | 154/44 |
| 2,501,951 | 3/1950 | Lintz | 72/6 |
| 2,731,334 | 1/1956 | Wissmiller et al. | 220/567 |
| 2,738,094 | 3/1956 | Fowler | 220/9 |
| 3,312,028 | 4/1967 | Schroyer | 52/478 |
| 3,456,835 | 7/1969 | Marcmann | 220/9 |
| 3,555,758 | 1/1971 | Schroter | 52/309 |
| 3,820,292 | 6/1974 | Fitzpatrick | 52/81.5 |
| 3,945,236 | 3/1976 | Hooper | 220/4.12 |
| 3,948,412 | 4/1976 | Bennett | 220/9 A |
| 4,004,394 | 1/1977 | Bennett | 52/741 |
| 4,004,429 | 1/1977 | Mouton, Jr. | 52/81.4 |
| 4,044,517 | 8/1977 | Schroter | 52/248 |
| 4,122,640 | 10/1978 | Commins et al. | 52/248 |
| 4,181,235 | 1/1980 | Baysinger | 220/565 |
| 4,223,797 | 9/1980 | Skakunov | 220/565 |
| 4,225,055 | 9/1980 | Hills et al. | 220/435 |
| 4,230,293 | 10/1980 | Hamm et al. | 52/249 |
| 4,338,756 | 7/1982 | Crothers | 52/539 |
| 4,347,949 | 9/1982 | Bennett | 220/415 |
| 4,442,639 | 4/1984 | Lindsey et al. | 220/567 |
| 4,534,490 | 8/1985 | McBride | 220/435 |

OTHER PUBLICATIONS

"Standing Seam Roof Systems" sales literature by Insultherm, Inc. (1981).

PDM Journal, pp. 2–4, "ROI (Return on Insulation)", Fall, 1982.

Engineering Drawing, "Thermacon Non-Welded Roof Insulation System", Jun. 18, 1981.

*Primary Examiner*—Allan N. Shoap

*Assistant Examiner*—S. Castellano

*Attorney, Agent, or Firm*—Arnold, White & Durkee

[57] ABSTRACT

An insulating system for storage tanks uses vertical straps and horizontal cables to form a web on the outer surface of a spherical storage tank. Fasteners and clamps positioned at intervals along the vertical straps anchor the cables in place. Panel sections are positioned transversely to the horizontal cables, the panel sections having opposing side flanges that are folded over flanges on adjoining panel sections as well as the attachment means looped around the cable.

9 Claims, 3 Drawing Sheets

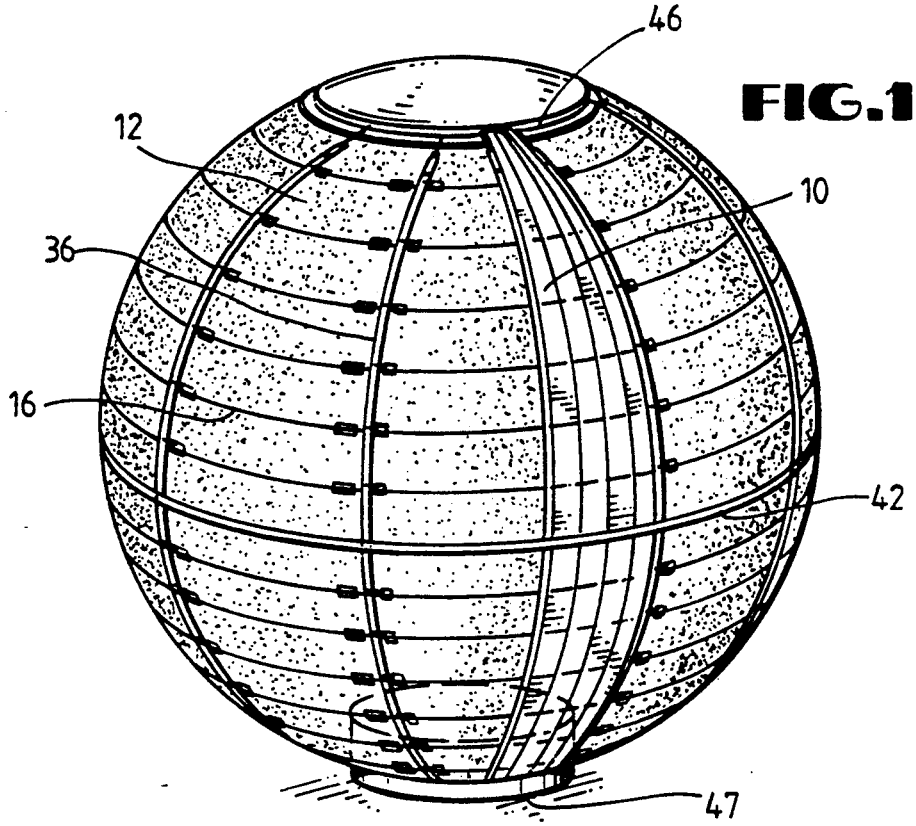
FIG.1A
FIG.2
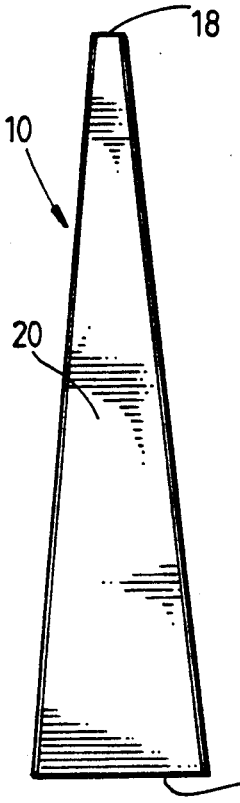
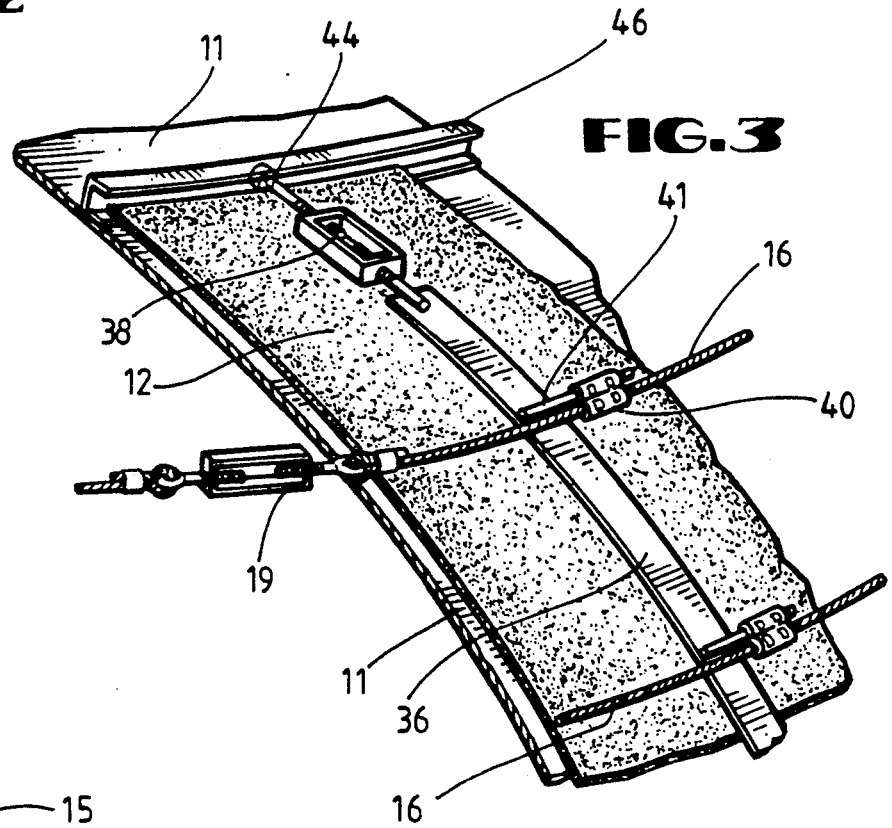
FIG.3

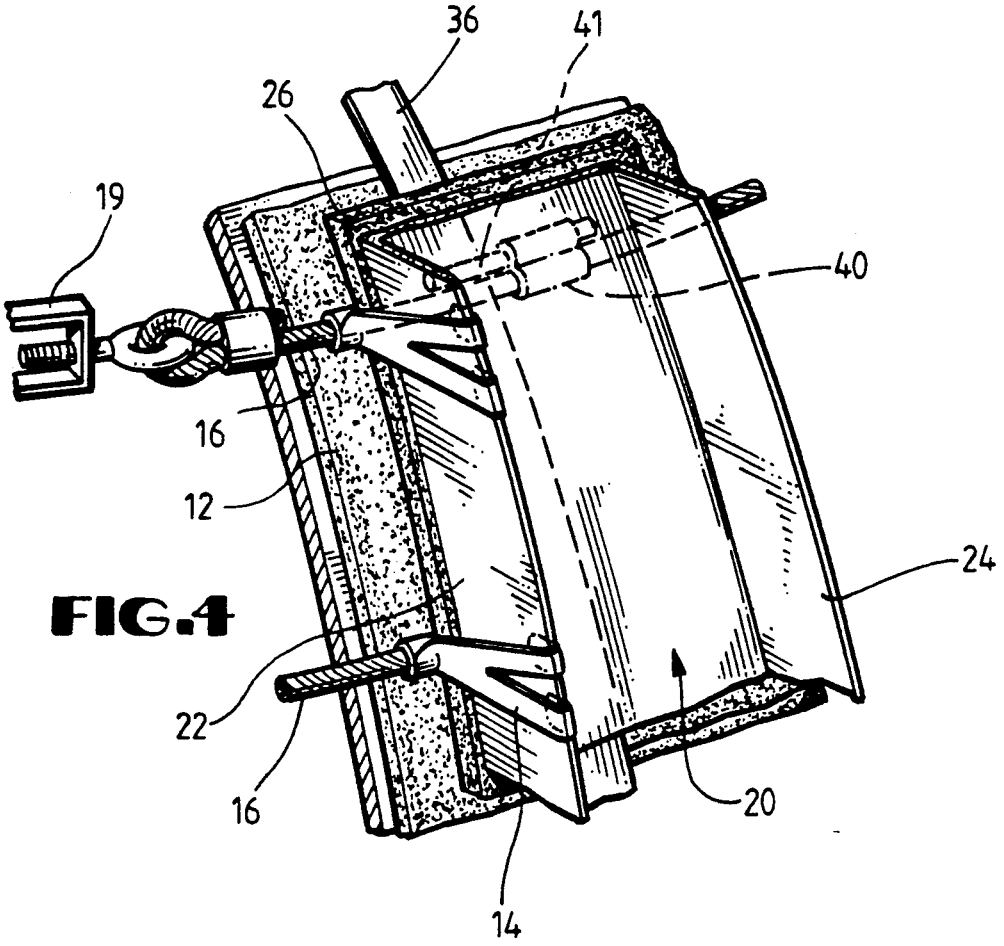
FIG.4
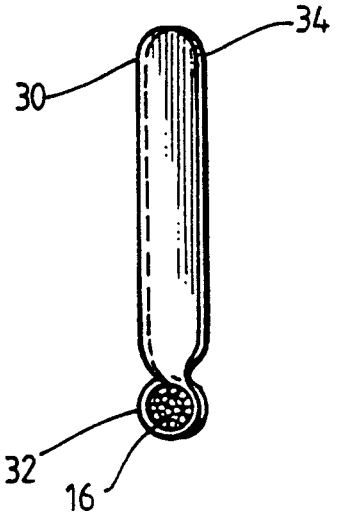
FIG.5
FIG.6
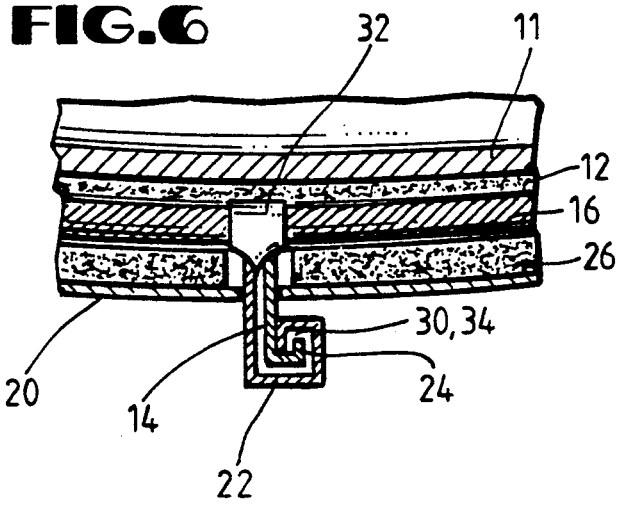

INSULATION SYSTEM FOR STORAGE TANKS

BACKGROUND OF THE INVENTION

Field of the Invention

The present invention relates generally to insulation systems and, more particularly, to insulated panel systems for tanks used in the storage of oil and chemical products.

Description of the Related Art

In the petroleum and chemical industries, it is customary to store liquids and the like within large tank structures which are usually installed out in the open where they are exposed to the elements, both heat and cold. These storage tanks usually comprise steel or other metallic tank structures which by reason of being installed out in the open, must be provided with a suitable insulating material so that the products in storage within the tanks may be kept at the desired temperatures. In storage tank insulation systems, it has been customary to apply some type of an insulating material exteriorly of the metallic tank structure and to securely bind the insulation material thereto by the use of an adhesive or by circumferential bands extending completely around the outside diameter of the tank and secured in a fixed position.

Various arrangements or systems have been provided in the past for securing insulated panels to storage tanks. Representative patents in the general area of securing insulated panels to storage tanks are U.S. Pat. Nos. 2,323,297, 2,501,951, 3,546,835, 4,004,394, 4,044,517, 4,338,756, and 4,347,949. These patents deal with insulating cylindrical tanks, not spherical tanks. The arrangements disclosed in these patents have not heretofore been successfully adapted for insulating spherical tanks.

U.S. Pat. No. 4,122,640 to Commins et al. relates to insulated tank jacketing system for cylindrical storage tanks in which cables are positioned horizontally about the tank's outer circumference. Commins et al. uses fastener having a sleeve-shaped portion that is positioned around the cable, and a bulbous rivet-like element at one end thereof positioned between the adjoining panel sections. The panel sections include opposed beaded sections which are then crimped over the bulbous rivet-like element to secure them to the cable.

U.S. Pat. No. 4,534,490 to the same inventor as the present invention, Mark A. McBride, assigned to Insultherm, Inc. of La Porte, Texas, relates to an improved system for insulating storage tanks which utilizes cables arranged horizontally about the tank's outer circumference, and panels mounted exteriorly of the cables. A metal strap is wrapped around the cable and then is folded between adjoining flanges of panel sections. This allows movement and flexing because the metal strap can slide along the cable, and the vertical seam (or "standing seam") allows flexing of the structure without detriment to the insulation system. The disclosure of U.S. Pat. No. 4,534,490 is incorporated herein by reference.

Securing insulating panels to the exterior of a metal storage tank with adhesive has inherent problems because the tank structure is exposed to varying temperature gradients with a result that the metallic shell expands and contracts. If an insulating material has been applied to the exterior surface of such tank by adhesively securing the same thereto, the adhesive bond between the metallic shell and the insulating material is caused to be broken due to such expansion and contraction. The result is that the insulating material is separated from the metallic shell with loss of insulation at such spots and areas.

It is undesirable and unsafe to employ welding methods to affix insulating panels directly to an existing tank which may either contain or be in the vicinity of flammable liquids, gases or solids. Welding methods generally require welding anchoring studs to the outside wall of the tank structure and then fastening insulated panels to these anchoring studs by means of metal screws or metal fasteners. Stud welding operations are undesirable because of hazards from explosion. Because of the cost of removal of the chemical or other liquid from the tank, it is prohibitively expensive to empty the tank to reduce the risk of welding to the tank. Welding to a spherical tank is undesirable because under applicable ASME standards for pressure vessels, including spherical storage tanks, such tanks must be stress relieved. Welding directly to the tank would require stress relieving the tank again.

While the system shown in U.S. Pat. No. 4,534,490 may be adapted for insulating spherical storage tanks, the spherical shape presents additional problems. Spheres are generally maintained at cold temperatures that cause tanks to contract. The cold temperatures result in condensation on the tank's outer surface. It is difficult to secure insulating material to the underside of the sphere as well as to the sphere's upper surfaces.

In the past, spherical tanks have been insulated by first spraying or otherwise applying a layer of insulating material onto the spherical tank, then applying a mastic or other coating externally of the insulation, and/or pop-riveting panels together to provide a protective cover over the insulating material. The mastic or other coating is susceptible to deterioration from sunlight or other elements. Pop-riveting has been undesirable because it involved puncturing or piercing the underlying vapor barrier surrounding the tank and the condensation moistened the insulation material.

SUMMARY OF THE INVENTION

The present invention overcomes the above problems and disadvantages by providing an improved insulated tank jacketing system for storage tanks, that is particularly useful for spherical storage tanks. The system includes vertical straps and horizontal cables positioned at spaced intervals along the outside of the tank structure. The straps and cables form a web which is extensible and flexible during expansion and/or contraction of the tank. Insulating material may be applied directly against the tank interiorly of the straps and cables. Another layer of padding or insulating material may be applied exteriorly of the straps and cables. Then the panels are fastened to the web. The panels are preferably trapezoid-shaped. Metal fasteners interposed around each cable hold the panels thereto in such a manner that there is no restriction of the cable from expansion or contraction. Each panel has a channel-shaped section with substantially upstanding and opposed side flanges. The panels can vary in length and width such that the top end of each panel mates with an adjoining panel near the top of the tank, and the bottom end of each panel mates with an adjoining panel at or near the bottom of the tank.

BRIEF DESCRIPTION OF THE DRAWINGS

FIG. 1A is an isometric view of a spherical storage tank structure supported on a base, provided with the insulation panel system that is partially installed according to a preferred embodiment of the present invention.

FIG. 2 is a front view of a trapezoid-shaped panel for use with insulating spherical storage tanks in a preferred embodiment of the invention.

FIG. 3 is an isometric view illustrating the method of securing the cables to the vertical straps in a preferred embodiment of the invention.

FIG. 4 is an isometric view illustrating the method of securing panel sections to the cables according to a preferred embodiment of the invention.

FIG. 5 is a vertical side view of the continuous fastener looped around one cable according to a preferred embodiment of the invention.

FIG. 6 is a section view of the joint between a pair of panels with the continuous fastener being shown looped around the cable and interposed between the panels.

DESCRIPTION OF A PREFERRED EMBODIMENT

Figure 1B:
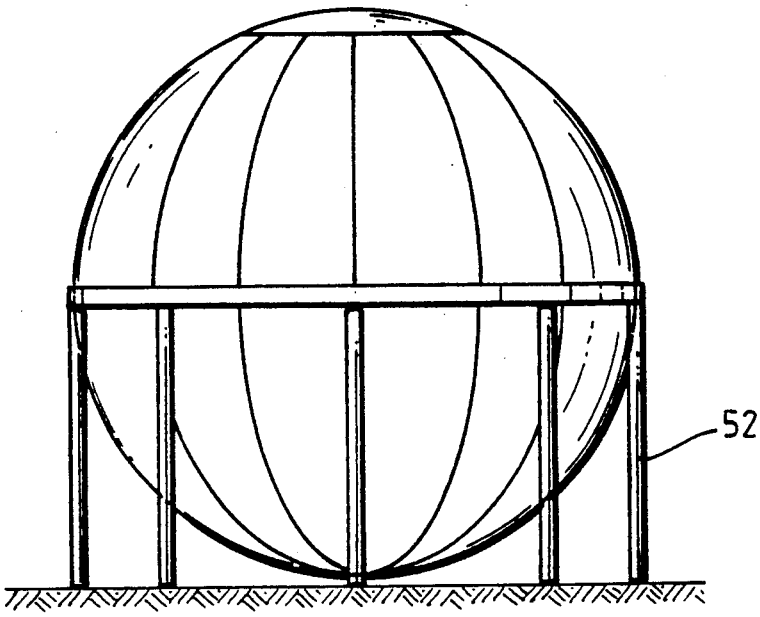
FIG. 1B is an isometric view of a spherical storage tank structure supported on legs.

With reference to the drawings, and in particular FIGS. 1A and 1B, a preferred embodiment of the present invention is illustrated comprising panels 10 attached to the surface of a typical storage tank structure that is spherical in shape. Although the present invention is particularly useful for insulating spherically shaped tanks, it will be understood that the invention is not restricted by the shape of the tank, and indeed may be useful for tanks of various different shapes.

Insulation material 12 may be applied directly to the tank surface 11, for example by spraying. Alternatively, insulating material may be affixed to each panel. Regardless of the method of applying the insulation, the present invention provides a system that not only protects the insulation material from the elements, but also provides a sealed vapor barrier around the tank structure. Thus, the present invention may be useful in conjunction with various different insulation application methods for enhancing and extending the use of the insulation on tank structures.

In the embodiment shown in FIG. 1A, the spherical storage tank is supported on base 47. In the embodiment of FIG. 1B, the tank is supported on legs 52 positioned at intervals around the tank. Typically, a spherical tank will have ten or more legs, which connect to the tank at the midpoint of the tank. The top of the tank typically is provided with a rim 46 curved to the radius of the tank. Rim 46 preferably is 2½" wide and ¼" thick. A series of vertical straps 36 are anchored or otherwise secured to base 47 and rim 46. Also shown in FIG. 1 is a cover strip 42 which runs horizontally around the midpoint of the spherical tank. The cover strip preferably is a steel or aluminum flat bar that is 7 inches in width and ⅛ inch in thickness. The midpoint of the tank also may be provided with a flange (not shown) for anchoring or securing vertical straps 36 thereto.

The number of vertical straps 36 may be varied depending on the size and circumference of the storage tank. The vertical straps may be fastened to existing structure at the bottom of the tank, midpoint of the tank, and top of the tank by threaded fasteners, chains, or other means. Preferably, each of the vertical straps is a steel or aluminum strap that is 1½ inch in width and ⅛ inch in thickness.

Now referring to FIG. 3, each of the vertical straps 36 is secured to rim 46 or similar supporting structure at the top, bottom and/or midpoint of the tank. A turnbuckle 38 is provided at the end of each vertical strap 36 to tension the strap. The turnbuckle 38 may be secured directly to rim 46 by bolts 44, chains, or other means depending on the specific configuration of the supporting structure.

After the vertical straps are installed at intervals around the exterior of the tank, stranded wire cables 16 are positioned horizontally at spaced intervals about the outer circumference of the tank, and are tightened and held in place by turnbuckles 19 which are at the end of each cable. The cables 16 preferably are made up of a series of twisted steel wires and are horizontally disposed in a generally parallel spaced arrangement. The number of cables 16 may be varied depending on the size and circumference of the storage tank. Typically, the cables are positioned at intervals of approximately 3 feet. The cables preferably are approximately ¼ inch in thickness.

Cables 16 are fastened to vertical straps 36. In a preferred embodiment, a metal rod or bar 41 is welded transversely to each vertical strap 36. The metal rod 41 is preferably a steel or aluminum rod ¼ inch in thickness and 3–10 inches in length. Then clamp 40 is crimped around both the metal rod 41 and the cable 16. Each clamp 40 is preferably a swedge (for example, a commercially available Nicopress copper sleeve) which fits around both the metal rod 41 and the cable 16. The clamp 40 then is swedged to securely hold the cable to the rod or, if desired, to allow shifting of the cable longitudinally.

The vertical straps 36 and horizontal cables 16 form a strong and flexible web around the outer surface of the storage tank, which is capable of flexing in severe weather conditions, and when the tank structure expands and contracts due to temperature changes. The web may be installed quickly and economically without the use of specialized tools and equipment.

In a preferred embodiment, ¼" thickness polypropylene padding 26 is installed outside the web to improve the vapor barrier and to prevent the web from showing through the panels or puncturing the panels.

Panel sections are attached exteriorly of the web. In a preferred embodiment for use with spherical storage tanks, each panel 10 comprises a channel-shaped, roll formed metal section 20 with a trapezoid shape, as shown in FIG. 2. The panels may be aluminum with a surface coating if desired. The first end 15 of the panel is substantially wider than the second end 18 of the panel. For example, the first end may be approximately 3 feet in width, and the second end may be 3 inches in width. The panels are flexible to curve over the shape of the spherical tank. It is preferred that one set of panels be installed above the midpoint of the tank, and a second set of panels be installed below the midpoint of the tank.

Now referring to FIG. 4, the opposing edges of section 20 are provided with an upstanding and opposed straight first flange 22 and second flange 24. First flange 22 is slightly taller than second flange 24. First flange 22 can be folded over second flange 24 when a pair of panels are disposed in adjoining relationship.

Although it is preferred that insulation material be affixed directly to the tank, each panel can be backed with a suitable insulating material layer such as one made of expanding polyurethane foam secured to the underside of the panel.

Panels 10 are affixed crosswise of cables 16 in the following fashion by means of a continuous piece of strapping material or fastener 14. Each fastener 14 is a thin continuous piece of strapping material having a first end 30, a middle section 32 and a second end 34, as shown in FIG. 5.

Now referring to FIG. 6, fastener 14 is first inserted around and under a cable 16 such that the middle section 32 of the fastener rests around the periphery of the cable with the first end 30 and second end 34 disposed 90° or rotated about the cable and placed in side by side spaced relationship with respect to each other. Then a pair of panels are placed crosswise to the cable such that the second flange 24 of the first panel 10 is spaced in side-by-side spaced relationship with the first flange 22 of the second panel. The first end 30 and second end 34 of the fastener 14 are then bent over the top of the second flange 24. The first flange 22 of the second panel section is then folded about the ends 30 and 34 of the fastener and over the second flange 24 of the first panel. An electric closure tool or the like provided with rollers that roll first flange 22 and second flange 24 over the fastener 14 is moved along the tank seam, closing the seam. The flanges are folded over again as same tool is once again moved along the seam formed by the adjacent flanges, with the finished closure seam being as illustrated in FIG. 6.

Figure 7:
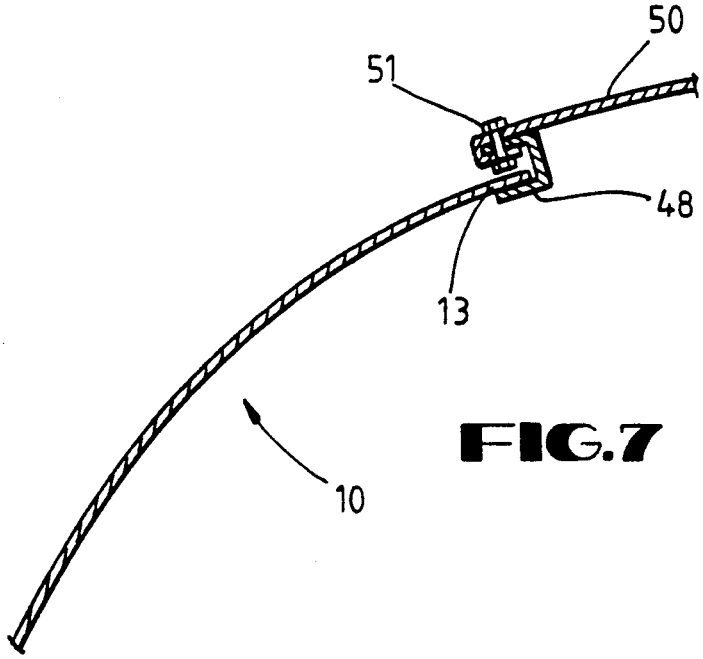
FIG. 7 is a section view of the method of attaching a protective cap to the end of a panel at the top or bottom of the storage tank according to a preferred embodiment of the invention.

After the panels are installed, cover strip 42 may be installed at the midpoint of the tank to cover the ends of the panels. Additionally, as shown in FIG. 7, a protective metal plate 50 may be installed to cover the narrow end 13 of each trapezoid-shaped panel 10 near the top and bottom surfaces of the tank. Protective plate 50 may be attached to a "C" shaped section 48 that fits around the narrow end 13 of each panel, and connected with pop rivet 51. Thus, the protective plate may be installed without piercing the panel section and without sacrificing the integrity of the vapor barrier around the tank.

The present invention provides a panel system that seals the insulation from the elements, without piercing the vapor barrier or otherwise allowing moisture to penetrate the exterior to reach the insulation. Another advantage of the present invention is that it allows substantial flexing between adjacent panel sections. For example, cable 16 will be allowed to rotate due to expansion and contraction of the system. The vertical straps allow flexing of the cables to prevent damage due to expansion, contraction or other movement of the cables. Also, because the first flange 22 and second flange 24 are double-rolled over the fastener 14, the present invention allows for a continuous uninterrupted closure seam having no exposed joints for possible leakage and subsequent corrosion.

Although variations in the embodiment of the present invention may not each realize all the advantages of the invention, certain features may become more important than others in various applications of the device. The invention, accordingly, should be understood to be limited only by the scope of the appended claims.

What is claimed is:

1. A system for covering a storage tank wall, comprising:

(a) a plurality of straps arranged along the outer surface of the tank wall in substantially vertical alignment;

(b) a plurality of attaching means at vertically spaced locations along each of the straps;

(c) a plurality of cables arranged along the outer surface of the tank in substantially horizontal alignment;

(d) means for securing and tightening each of the cables;

(e) a plurality of clamping means adapted to clamp around an attaching means and around a cable to hold the cable next to the attaching means;

(f) a plurality of trapezoid-shaped panels secured transversely to the plurality of cables; and (g) fastener means securing a pair of panels to each cable.

2. The system of claim 1 wherein the cables comprise stranded wire cables.

3. The system of claim 1 wherein the clamping means a sleeve shaped metal body configured to fit around the attaching means and cable.

4. The system of claim 1 wherein the attaching means comprises a metal rod affixed to the strap.

5. The system of claim 1 further comprising a layer of padding positioned exteriorly of the cables and straps.

6. The system of claim 1 wherein the fastener means comprises a thin metal strap, and wherein one of the panels has an upstanding side flange which is foldable over the thin metal strap and a side flange of an adjoining panel.

7. An insulation system for spherical storage tanks, comprising:

(a) a plurality of metal straps spaced at intervals along the outer surface of the tank wall in substantially vertical alignment, each of the straps provided with tensioning means;

(b) a plurality of metal rods welded to the straps in substantially horizontal alignment at spaced intervals along the metal straps;

(c) a plurality of wire cables arranged along the outer surface of the tank in substantially horizontal alignment, each of the cables provided with tensioning means;

(c) a plurality of sleeve shaped clamps adapted to clamp around the metal rods and wire cables to hold the wire cable next to the metal rod;

(f) a plurality of trapezoid-shaped panels positioned transversely to the plurality of wire cables; and (g) a plurality of fasteners looped around the cables and secured between adjoining panels to secure the panels to the wire cables.

8. The insulation system of claim 7 further comprising attaching means to attach the ends of the metal straps at the top, bottom and mid-section of the spherical storage tank.

9. The insulation system of claim 7 further comprising at least one layer of insulating material between the panels and the tank outer surface.

* * * * *